United States Patent [19]

Oshima et al.

[11] 4,113,583

[45] Sep. 12, 1978

[54] METHOD FOR BRIGHTENING THE ELECTRODEPOSITS OF ZINC FROM ALKALINE ZINC ELECTROPLATING BATHS

[75] Inventors: Kathuhide Oshima, Tokyo; Haruyuki Takasaki, Ichihara; Akio Takahashi, Kisarazu, all of Japan

[73] Assignee: Dipsol Chemical Company, Ltd., Tokyo, Japan

[21] Appl. No.: 779,560

[22] Filed: Mar. 21, 1977

[30] Foreign Application Priority Data

Apr. 27, 1976 [JP] Japan ..... 51-47162

[51] Int. Cl.[2] ..... C25D 3/22; C25D 3/24

[52] U.S. Cl. ..... 204/55 Y; 204/55 R

[58] Field of Search ..... 204/55 R, 55 Y, 43 Z, 204/114

[56] References Cited

U.S. PATENT DOCUMENTS

| | | | |
|---|---|---|---|
| 3,318,787 | 5/1967 | Rindt et al. | 204/55 Y |
| 3,411,996 | 11/1968 | Rushmere | 204/50 Y |
| 3,730,855 | 5/1973 | Poor et al. | 204/55 R |
| 3,787,297 | 1/1974 | Beckwith et al. | 204/55 R |
| 3,954,575 | 5/1976 | Yanagida et al. | 204/55 R |
| 3,974,045 | 8/1976 | Takahashi et al. | 204/55 R |
| 4,045,306 | 8/1977 | Senge et al. | 204/55 R |

FOREIGN PATENT DOCUMENTS

| | | | |
|---|---|---|---|
| 1,496,742 | 7/1969 | Fed. Rep. of Germany | 204/55 R |

*Primary Examiner*—G. L. Kaplan

*Attorney, Agent, or Firm*—Oblon, Fisher, Spivak, McClelland & Maier

[57] ABSTRACT

A method for depositing bright zinc from zinc electrodeposition baths in which a compound prepared by reacting imidazole and/or at least one imidazole derivative with at least one organic compound which quaternizes nitrogen in said imidazole in the presence of water is added to the alkaline zinc electroplating baths.

6 Claims, No Drawings

METHOD FOR BRIGHTENING THE ELECTRODEPOSITS OF ZINC FROM ALKALINE ZINC ELECTROPLATING BATHS

BACKGROUND OF THE INVENTION

1. Field of the Invention

This invention relates to a method for brightening the electrodeposits of zinc from alkaline zinc electroplating baths.

2. Description of the Prior Art

Various types of brightener additives for alkaline zinc electroplating process such as an organic aldehyde compound combining with a substituent, a ketone compound, a heterocyclic compound, a sulfur organic compound and/or a water-soluble high molecular compound have been widely investigated. These brightener additives which have been developed in the prior art are not satisfactory for use in a specific alkaline zinc electroplating bath such as the zincate or zinc cyanide baths, so far as workability and the plated zinc at the high current density are concerned.

SUMMARY OF THE INVENTION

Accordingly, one object of the present invention is to a method for brightening by employing an additive which is well suited for workability at high current density and does not give "burnt" deposit or pits on the plated zinc.

Briefly, this object and other objects of the invention as hereinafter will become more readily apparent can be attained by providing a brightener additive for alkaline zinc electroplating baths which comprises a compound prepared by reacting imidazole and/or at least one imidazole derivative with at least one organic compound which quaternizes nitrogen in said imidazole in the presence of water.

DESCRIPTION OF THE PREFERRED EMBODIMENTS

The starting materials for the preparation of the brightener of this invention include imidazole and/or derivatives thereof such as 1-methylimidazole, 1-ethylimidazole, 2-methylimidazole, 1,5-dimethylimidazole, 1-ethyl-2-methylimidazole, 1-oxymethylimidazole or 1-vinyl imidazole and include the quaternizing agents such as monochloroacetic acid, benzyl chloride, chloroacetoamide, 3-aminobenzyl chloride, dichloroglycerine, methyl iodide, allyl chloride, dichloroethane and/or monochloropropane.

The brightener additives can be prepared by adding at least one quaternizing agent to imidazole and/or at least one derivative thereof in quantities ranging from one mole to 1.5 moles per mole of the imidazole and then reacting the materials for from 0.5 to 4 hours at from 40° to 100° C. in the presence of such water quantities that the reaction products are dissolved. The brightener additives thus prepared are added to the zincate electroplating bath in ratios of 0.1–3 g/l, or the zinc cyanide electroplating bath in ratios of 0.05–0.5 g/l.

The plated zinc of this invention once electrodeposited exhibits a considerably enhanced brightening effect and are satisfactory for use at high current density and moreover any "burnt" deposit or any pits are not found on the plated zinc.

The brightener additives of the prior art hereinafter disclosed can be added to the brightener additives of this invention, if desired.

Having generally described this invention, a further understanding can be obtained by reference to certain specific examples which are provided herein for purpose of illustration only and are not intended to be limiting unless otherwise specified. The Examples show the preparation of some of the brightener additives of the present invention and a bright zinc layer electrodeposited by each bath used containing one of the brighteners.

EXAMPLES

Imidazole, 1-ethylimidazole, benzylchloride, monochloroacetic acid and water were added to the following mixing ratios to a four-necked flask equipped with a thermometer, a condenser, a stirrer and a separatory funnel.

| Mixing ratios | | | |
|---|---|---|---|
| No.1 | Imidazole | 6.8 | g |
| | Benzyl chloride | 12.6 | g |
| | Water | 10.0 | g |
| No.2 | Imidazole | 6.8 | g |
| | Monochloroacetic acid | 9.5 | g |
| | Water | 10.0 | g |
| No.3 | 1-ethylimidazole | 8.2 | g |
| | Benzyl chloride | 12.6 | g |
| | Water | 10.0 | g |

The mixture was warmed to 80° C. for 1 hour. The reaction products thus prepared were diluted to 100 g with water.

The above water solutions were added at the various ratios to the zincate electroplating bath and the zinc cyanide electroplating bath of which the compositions are shown as follows:

| | |
|---|---|
| Bath of medium cyanide concentration (M-CN) | |
| Zn | 20 g/l |
| NaCN | 40 g/l |
| NaOH | 80 g/l |
| Bath of low cyanide concentration (L-CN) | |
| Zn | 10 g/l |
| NaCN | 12.5 g/l |
| NaOH | 70 g/l |
| Zincate bath (Z) | |
| Zn | 10 g/l |
| NaOH | 120 g/l |

The electroplating of zinc on steel was performed by passing an electric current at a bath temperature of 25° C.

The experimental results are shown in the following table.

Table

| Test Number | 1 | 2 | 3 | 4 | 5 | 6 | 7 | 8 | 9 | 10 | 11 |
|---|---|---|---|---|---|---|---|---|---|---|---|
| Kind of Bath | Z | | | | | | | L-CN | | M-CN | |
| | No.1 | Comparative Ex. | No.2 | | Comparative Ex. | No.3 | Comparative Ex. | No.1 | Comparative Ex. | No.2 | Comparative Ex. |
| Kind of This Invention | 1 | — | 0.8 | 0.8 | — | 2 | — | 0.1 | — | 0.05 | — |

Table-continued

| Test Number | 1 | 2 | 3 | 4 | 5 | 6 | 7 | 8 | 9 | 10 | 11 |
|---|---|---|---|---|---|---|---|---|---|---|---|
| Kind of Bath | Z | | | | | | | L-CN | | M-CN | |
| | No.1 | Comparative Ex. | No.2 | | Comparative Ex. | No.3 | Comparative Ex. | No.1 | Comparative Ex. | No.2 | Comparative Ex. |
| Brightner Additive (g/l) | | | | | | | | | | | |
| A (g/l) | 4 | 4 | — | — | — | 2 | 2 | 0.5 | 0.5 | — | — |
| B (g/l) | — | — | 6 | 6 | 6 | 3 | 3 | — | — | — | — |
| Anisaldehyde (g/l) | 0.5 | 0.5 | — | 0.5 | — | 0.5 | 0.5 | 0.2 | 0.2 | 0.1 | 0.1 |
| Polyvinyl aldehyde (g/l) | — | — | — | — | — | 0.2 | 0.2 | 0.2 | 0.2 | 0.2 | 0.2 |
| Current Density | 0.5–6 | 0.5–2 | 0.5–7 | 0.5–7 | 0.5–2 | 0.5–8 | 0.5–2.5 | 0.3–8 | 0.3–3 | 0.3–8 | 0.3–4 |
| Brightness of plated Zink | Very Good | Good | Good | Very Good | Fairly Good | Very Good | Good | Very Good | Good | Very Good | Good |
| Burntdeposit or Pits on Plated Zink (Current Density 4 A/dm²) | Not Found | Found | Not Found | Not Found | Found in Large Number | Not Found | Found | Not Found | Found in a little Number | Not Found | Found in a little Number |

The comparative examples in which two kinds (A and B) of brightener additives in the prior art were added to the same alkaline electroplating baths in place of the present brightener additives are shown together in the table. The brightener additive A is a 50% water solution of the reaction product of methylamine and epichlorohydrin, and the brightener additive B is a 50% water solution of polyethyleneimine (polymerization degree, about 2000).

Moreover, though the cases in which the brightener additive No. 2 or No. 3 was added in the electroplating bath L-CN, and the cases in which the brightener additive No. 1 or No. 3 was added in the electroplating bath M-CN were not shown in the above table, the same superior results as could be seen from the cases of the electroplating bath Z were obtained in bath cases.

Having now fully described this invention, it will be apparent to one of ordinary skill in the art that many changes and modifications can be made there to without departing from the spirits or scope of the invention as set forth herein.

What is claimed as new and intended to be covered by Letters Patent is:

1. A method for the electrodeposition of bright zinc which comprises electrodepositing zinc from an aqueous alkaline zinc electroplating bath comprising a water soluble compound prepared by reacting an imidazole compound which is imidazole and/or at least one substituted imidazole with at least one organic compound selected from the group consisting of monochloroacetic acid, benzyl chloride, chloroacetamide, 3-aminobenzyl chloride, dichloroglycerine, methyl iodide, allyl chloride, dichloroethane, and monochloropropane, which quaternizes nitrogen in said imidazole compound in the presence of water.

2. The method of claim 1, wherein said substituted imidazole comprises at least one compound selected from the group consisting of 1-methylimidazole, 1-ethylimidazole, 2-methylimidazole, 1,5-dimethylimidazole, 1-ethyl-2-methylimidazole, 1-oxymethylimidazole and 1-vinylimidazole.

3. The method of claim 1, wherein the quaternizing agent is added to the imidazole compound in quantities ranging from 1 to 1.5 moles per mole of the imidazole.

4. The method of claim 1, wherein the imidazole compound is allowed to react with the quaternizing agent at from 40° to 100° C. for from 0.5 to 4 hours in the presence of such water quantities that the reaction products are dissolved.

5. The method of claim 1, wherein the imidazole compound is imidazole and the electroplating bath is a zincate or cyanide bath.

6. The method of claim 1, wherein the imidazole compound is 1-ethylimidazole and the electroplating bath is a zincate bath.

* * * * *